United States Patent [19]

Peterson

[11] 4,104,946

[45] Aug. 8, 1978

[54] VOICING SYSTEM FOR ELECTRONIC ORGAN

[76] Inventor: Richard H. Peterson, 11748 Walnut Ridge Dr., Palos Park, Ill. 60464

[21] Appl. No.: 696,981

[22] Filed: Jun. 17, 1976

[51] Int. Cl.[2] ..... G10H 1/02

[52] U.S. Cl. ..... 84/1.24

[58] Field of Search ..... 84/1.01, 1.11, 1.19–1.24, 84/1.26

[56] References Cited

U.S. PATENT DOCUMENTS

| | | | |
|---|---|---|---|
| 3,569,604 | 3/1971 | Schwartz | 84/1.19 |
| 3,748,598 | 7/1973 | Munch, Jr. et al. | 84/1.24 |
| 3,855,893 | 12/1974 | Chase | 84/1.24 |
| 3,919,648 | 11/1975 | Uetrecht | 84/1.19 |
| 3,930,429 | 1/1976 | Hill | 84/1.01 |
| 3,938,378 | 8/1968 | Olson | 84/1.19 |

*Primary Examiner*—Robert K. Schaefer
*Assistant Examiner*—Vit W. Miska
*Attorney, Agent, or Firm*—Spencer E. Olson

[57] ABSTRACT

In a voicing system for electronic organs, square wave signals from a tone generator are converted to a waveform of another shape, the harmonic structure of which is useful for producing certain organ voices. This modified waveform is further modified, as by integration or differentiation, to produce signals of yet another wave shape whose harmonic content makes it useful for deriving still other organ voices. In one embodiment, the square wave pulses are initially converted to narrow pulses which are particularly suitable for the production of reed and certain string voices, and these sharp, narrow pulses are integrated to produce, in effect, a separate source of signals having a sawtooth waveform the harmonic structure of which is particularly suitable for production of cello, diapason and flute sounds. In another embodiment, the square wave pulses are first combined to produce a synthesized sawtooth waveform which may be applied to appropriate filters to produce cello, diapason or flute sounds, and the synthesized sawtooth waveform pulses are differentiated to produce a source of sharp, narrow pulses which may be applied to other suitable filter networks to produce other organ voices such as reed or string sounds. In the process of conversion from one pulse shape to the other, whether by integration or differentiation, all harmonics of the starting pulse, regardless of the frequency of the note, are shifted in phase by substantially 90°, thereby enabling the selective combination of the voice signals from the voicing filters in a way such as to minimize deleterious cancellation of certain harmonics when two or more stops of the organ are played simultaneously.

23 Claims, 7 Drawing Figures

VOICING SYSTEM FOR ELECTRONIC ORGAN

BACKGROUND OF THE INVENTION

This invention relates to electronic musical instruments, and, more particularly, to a voicing system for an electronic organ.

Currently, the voices representing the different stops of an electronic organ are produced from pulse signals of a particular waveform, usually square wave pulses generated by a single tone generator system. By converting the square wave pulses to electrical signals having other wave shapes by various kinds of filtering and/or by selective combination of signals of various waveforms, signals are obtained which, when reproduced by a loudspeaker, produce sounds reasonably simulative of the different stops. Such systems have certain disadvantages and present design difficulties which more often than not result in compromises, the nature and severity of which will be appreciated from a brief review of the historical development and present state of the art of electronic organs.

Early in the development of electronic organs, it was commonly considered most desirable to use sawtooth waveform signals because they include all harmonics of the fundamental frequency up to a high order, albeit diminishing in amplitude in inverse proportion to the order of the harmonic. The tone quality of an organ voice, to the degree that it is determined by the harmonic structure of the tone, is determined by the harmonics present and their relative amplitudes. For example, the sounds produced by the family of "stopped" organ pipes contain odd order harmonics only, whereas the sounds produced by "open" organ pipes contain both odd and even order harmonics. There being no simple filtering technique for removing the even order harmonics from a sawtooth waveform signal, it was difficult, if not impossible, to produce from a sawtooth waveform signal a signal representative of a "stopped" organ pipe until Winston Kock taught in U.S. Pat. No. 2,233,948 (1941) a system of combining two sawtooth waveform signals, the frequency of the second harmonic of one of which is twice the fundamental frequency of the other, by inverting the phase of the higher frequency signal and combining the higher frequency signal at half amplitude with the lower frequency signal, thereby to cancel out the even harmonics of the lower frequency signal. This technique, known as "outphasing", enabled the derivation from sawtooth signals of voicing signals containing the only odd-order harmonics, and organ systems in which the tone generator signals were of sawtooth waveform, were manufactured and sold for some time.

More recently, tone generators for electronic organs are almost universally of the type that produce a square wave signal because of the simplicity and correspondingly lower cost of using digital techniques to derive from a single, or relatively small number of, master clock oscillators square waves having frequencies representing the tones of different octaves. However, a square wave signal has only odd harmonics, and produces a very hollow sound when acoustically reproduced, and since the clarinet is the only orchestral instrument whose sound signal has predominantly odd harmonics, it has been necessary to derive sawtooth waveform signals from the square wave signals by synthesis in order to have available signals containing both even and odd harmonics required to produce most organ voices. A synthesis technique known as "stair-stepping", which is essentially the reciprocal of the outphasing technique taught by Knock, is described in Langer U.S. Pat. No. 2,533,821 (1950) and consists of adding in the correct proportions phase-locked square wave signals (which contain only odd harmonics the amplitudes of which are inversely proportional to the harmonic order) of a fundamental frequency, twice the fundamental frequency, four times the fundamental frequency, and so on, to produce a "stepped" waveform which, if it has enough "steps", is musically equivalent to a sawtooth waveform. It has been found in practice that for most purposes a stairstep wave having three steps (i.e., a combination of fundamental, the second harmonic at half amplitude and the fourth harmonic at one-fourth amplitude) is musically acceptable, the even harmonics falling in in substantially the ratios in which they would appear in a sawtooth wave.

Thus, most electronic organs today are based on the use of square wave signal generators and the selective combination of such square wave signals by the Langer synthesis technique to derive signals having the desired harmonic content of a sawtooth waveform signal. Filters of various types, such as low-pass, high-pass, band-pass, or combinations of these, are used to modify the sawtooth or square wave signals, as the case may be, to produce signals having other waveforms appropriate to the organ voice it is desired to simulate. Flute and clarinet tones are derived by suitably filtering the synthesized sawtooth waveform signal, and within these two broad families, the other voices are derived by suitable filtering and combination of the modified signals. In a very complicated organ, a separate filter could be provided for each note, each being tailored to alter the square wave signal in just the right way for its note, but because of the complexity and attendant high cost of this approach, it is much more common to go to the other extreme and provide a signal filter per organ voice for the entire range of the keyboard. Obviously, in a system in which all of the square wave signals corresponding to the keys played at a given time are mass processed by a single filter, the filter is necessarily a compromise in that it will have a different effect on the waveform of tones in the lowest octave than it will have on higher frequency tones; in spite of the necessary compromise, however, this approach is acceptable for many purposes and is utilized in many modern organ systems.

A primary problem inherent in filters commonly used in organs, be they low-pass, high pass, band-pass, or of other types, is that over the range of frequencies encountered in an organ having sixty-one notes, or forty-four notes in smaller organs, there is an upsetting of the scaling of a given stop because anything that affects the harmonic partials of the lowest key on the keyboard would also have an effect on the fundamental frequency of tones in the next higher octave. That is, if a filter were selected to attenuate the second harmonic of note $C_1$, since the fundamental of $C_2$ is the same frequency of the second harmonic of $C_1$, the filter would have the same effect on the fundamental of note $C_2$, and so on up the keyboard. There is no way to avoid compromise in this kind of system. For example, if one were to attempt to change a sawtooth signal into a waveform such as would produce a diapason sound on the one hand, or into a flute on the other hand, which requires even more severe attenuation of the harmonics, or if one were to attempt to change the sawtooth signal so that the resulting sound is brighter, like string or reed tones, the sawtooth signal must be warped rather drastically; thus, if one attempts to use a common filter to drastically warp the sawtooth signal into a number of different voices and still permit either the selective or simultaneous play of a string stop with the flute, or with the diapason, for example, something must suffer. If one goes up the scale, the flute tones will fall off in intensity and the string tones at the same time become louder. While there are ways to minimize these effects, such as by dividing the notes into small groups and applying separate filters to each group, or by prescaling or adjusting the amplitudes of the notes to preemphasize in some cases the higher notes so that when subjected to filters of the lowpass type which roll off the harmonics, the scaling would be brought back closer to what it should be with less severe distortion, obviously these "fixes" add to the complexity and cost of the voicing system.

The specific nature of the problems introduced when a single filter per voice is used for the entire keyboard range of frequencies will be better seen from an analysis of FIG. 1 which illustrates the normal connection of filter networks commonly used for modifying a sawtooth waveform input signal to produce signals which upon reproduction simulate common organ voices. The sawtooth signal applied at input terminal 10 is applied to the input of each of four parallel-connected filter circuits each of which includes a stop switch for connecting the output signal from the filter to an output terminal 12. Although technically not a filter, the uppermost parallel-connected path consists of a resistor 14 which, upon closure of a stop switch 16 marked CELLO attenuates by a predetermined amount and couples to the output terminal 12 a sawtooth signal corresponding in frequency to the note being played. The next filter is of the low-pass type and includes series-connected resistors 18 and 20 and a capacitor 22 connected between the junction of the resistors and ground. This type of filter attenuates those partials having frequencies where the reactance of the capacitor is low compared to the resistance of the resistors so that above some cutoff frequency there will be a gradual decrease in the amplitude of the higher order harmonics. The rolloff is very gradual at frequencies slightly above the cutoff frequency, ultimately reaching a point at which the rolloff is 6 dB per octave. By proper selection of component values, this low-pass filter modifies the sawtooth waveform input signal such that the resulting waveform when coupled to the reproducing equipment by closure of stop switch 24 produces the PRINCIPAL organ voice. The next filter, which may be called a DIAPASON filter, is a two-stage, low-pass filter including series-connected resistors 26, 28 and 30, a capacitor 32 connected to ground from the junction of resistors 26 and 28 and a capacitor 34 connected from the junction of resistors 28 and 30 to ground. Its operation is similar to that of the described one-stage, low-pass filter except that at frequencies substantially above the cutoff of the two cascaded stages, its attenuation is 12 dB per octave. The nature of the filter is such that it has a very gradual rolloff, with the knee of its characteristic set by the relative values of the resistors and capacitors; this is desirable when one is seeking to produce a diapason tone. Since organ voicing is a very subjective art, the relative values of resistors and capacitors are normally adjusted until the desired sound is obtained which might result in the knee of both stages being at the same frequency, or they might happen to be at different frequencies. The DIAPASON tone signal from the two-stage filter is coupled to the output terminal 12 by a stop switch 36. The fourth filter, which is conventionally used to produce reed sounds from a sawtooth waveform input signal is a high-pass filter including a capacitor 38 and a resistor 40 connected in series, the values of which are such that frequencies above the operating point of the filter are accentuated by up to 6 dB per octave. The output of this filter may be coupled to the output terminal 12 by closure of a REED stop switch 42.

Filters of the kinds shown in FIG. 1, which it is to be understood illustrate only a few of many different varieties utilized in electronic organs, are effective to more or less simulate the characteristics of the intended organ voices and are widely used in simpler organs. The filters selected for illustration do, however, serve to point up a difficulty that has plagued designers of electronic organs for many years, namely, that not only does the response of each of the filters (except the cello filter) vary with frequency, but each shifts the phases of the harmonic partials; at frequencies at which a filtering effect at the rate of 6 dB per octave per stage occurs, the phase of whatever signal is being transmitted is shifted by 90°. In other words, each RC stage, whether in a low-pass or high-pass configuration, is capable of introducing a phase shift of up to 90°, and it will produce substantially a 90° phase shift for all frequencies at which the filter produces a 6 dB per octave filtering effect. In order not to upset the scaling to a degree that the system cannot be used, these filters of necessity are designed to become effective at frequencies somewhere near the middle of the audio frequency spectrum; if their cutoff were set at a point so as to have the filter influence the low-order harmonic partials of the lower notes on the keyboard, all of the partials, including the fundamental, of the highest notes on the keyboard would be wiped out and the resulting signal unusable. The result of this compromise is that all tones at the lower end of the keyboard tend to be too bright by reason of the lower order harmonics being too strong in the case of the low-pass filters, and thus not nearly as effective as one would like.

The consequences of the phase shifts introduced by the filters become particularly serious when more than one stop is played at the same time, which, of course, is more often than not the case in electronic organs, since the effect of a given filter on the phase of any particular partial of any given stop is likely to be random and unpredictable because the cutoff frequencies of the filter as compared to the frequency of the fundamental of the note being played at a given time will vary depending upon the key being played. Obviously, a two-stage, low-pass filter will produce a rather drastic phase shift of most of the partials of the upper notes of the keyboard, the cello filter (a simple resistor) produces no phase shift, and the phase shift of the high-pass reed filter will be in the opposite direction from the phase shift of the low-pass filters, so that when a combination of stops is played, some of the partials will be additive and others will be subtractive, with the consequence that several voices no longer have their desired characteristics after being combined.

It is evident from the foregoing that there has been a long-standing need for an organ-voicing system which is capable of deriving from a simple waveform signal, such as the square wave signal from a commonly-used tone generator, signals having waveforms more amenable to filtering to produce signals representative of different organ stops which will retain their natural sound when two or more organ stops are played simultaneously. Among the objects of the present invention, therefore, is to provide such an organ-voicing system. A more specific object of the invention is to provide in an organ-voicing system that utilizes square wave signals as primary tone signals, a method and apparatus for deriving therefrom pulse signals of other wave shapes which with less drastic filtering produce tonally better organ voices, and at the same time greatly minimize the improper addition and/or subtraction of partials when two or more voices are played simultaneously.

SUMMARY OF THE INVENTION

Briefly, these and other objects of the invention which will become apparent as the description proceeds, are achieved in a system including a source of square wave signal having fundamental frequencies corresponding to the notes of a musical scale, by converting the square wave signal to a waveform of a different shape which contains both even and odd harmonic partials of such relative amplitude as to be useful when filtered to produce certain organ voices. This modified waveform is then further altered to produce signals of yet another waveform whose harmonic content makes it useful for deriving other organ voices. In a first embodiment, the square wave pulses are initially converted to sharp, narrow pulses which are then integrated in a plurality of operational amplifier integrators, one for each octave, to produce signals having a sawtooth waveform, the outputs of each of the integrators being scaled and mixed in a suitable mixing amplifier which preferably takes the form of an operational amplifier. Thus, pulse signals of sawtooth waveform are available for application to suitable filter networks to produce signals simulative of cello, diapason and open flute voices, for example. Signals of yet another waveshape are obtained by differentiating the sawtooth waveform signals appearing at the output terminals of the integrators, the resulting signals having a waveform similar to the waveform of the signals initially applied to the integrators, namely, sharp, narrow pulses. The narrow pulse output signals from each of the differentiators are mixed in a suitable mixing amplifier, again preferably in the form of an operational amplifier, thereby to provide, in effect, a source of sharp, narrow pulses, the harmonic structure of which is particularly suitable for the derivation of signals simulative of reed and certain string sounds. In the process of conversion from one pulse shape to the other, whether by integration or differentation, all harmonics of the starting pulse, regardless of the frequency of the note, are shifted by substantially 90°, thereby enabling the selective combination of the voice signals from the voicing filters in a way such as to minimize cancellation of harmonics when two or more stops of the organ are played simultaneously.

In a second embodiment of the invention, the square wave pulses from the tone generator are first combined by the known "stairstepping" technique to produce a signal musically equivalent to a sawtooth waveform which may be applied to appropriate filters for the derivation of cello, diapason or open flute sounds, and the synthesized sawtooth waveform signals are also differentiated to convert them to sharp, narrow pulses which may be applied to other suitable filter networks to produce other voice signals, such as those that produce reed or string sounds. As in the first embodiment, all harmonics of the sharp, narrow pulses are shifted by substantially 90° in the differentiating process, thereby establishing the known phase relationship between its harmonics and the harmonics of the synthesized sawtooth waveform signal and allowing combining of the voice signals from the voicing filters in a way such as to minimize cancellaton of certain harmonics when two or more organ stops are drawn simultaneously.

In essence, then, both systems embody the principle of deriving from square wave pulse signals obtainable from the tone generating system of the organ two other sources of pulse signals of differing wave shapes but whose harmonics have a known phase relationship and each of which is uniquely useful for the production of different organ voices.

DESCRIPTION OF THE DRAWINGS

Other objects, features and advantages of the invention will become apparent, and its construction and operation better understood, from the following detailed description taken in conjunction with the accompanying drawings, in which.

DETAILED DESCRIPTION OF THE INVENTION

The system according to the invention utilizes as a primary source of tone signals a tone-generating system for producing signals of square waveform having foundamental frequencies corresponding to the note of a musical scale. These square wave signals are initially converted into a pulse signal having a waveform which contains both even and odd harmonics, two different techniques for which will be described.

Figure 1:
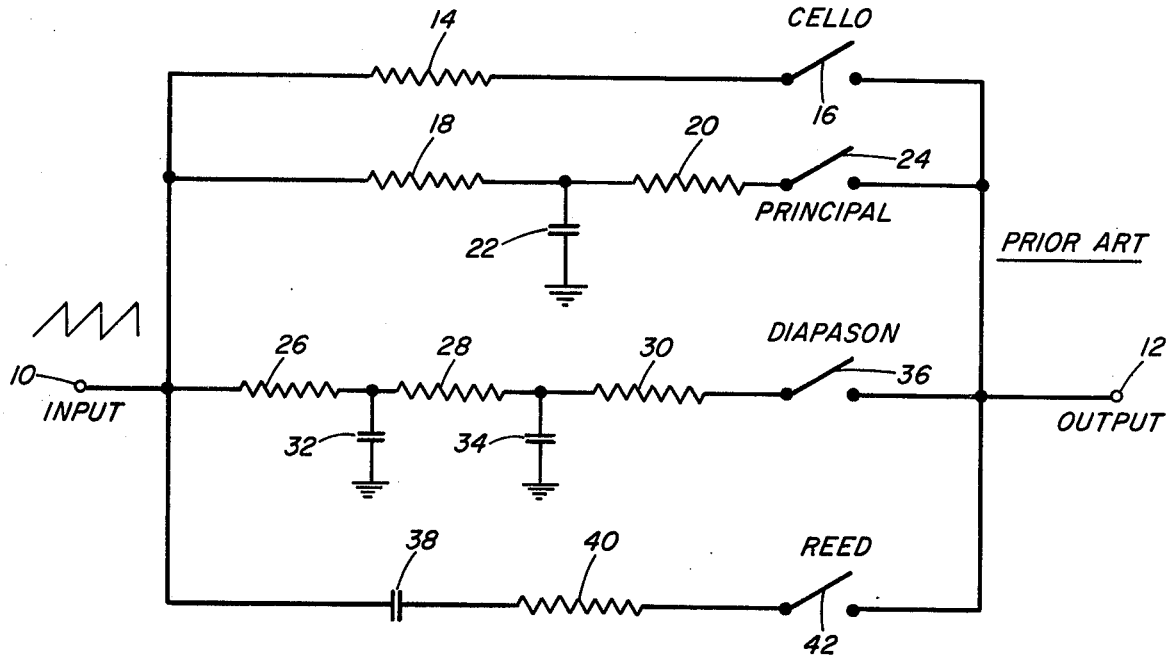
FIG. 1 is a schematic diagram of known filter networks, to which reference has already been made in describing the shortcomings of prior art voicing systems.
Figure 2:
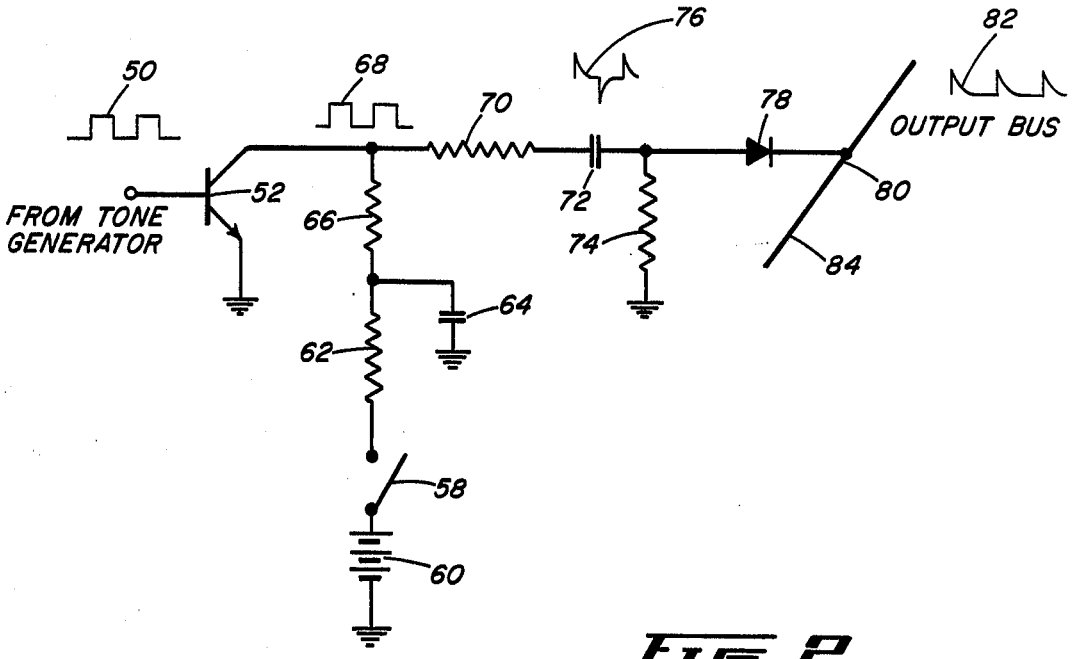
FIG. 2 is a circuit diagram of a gating and pulse-forming network for converting square wave signals to sharp pulse signals containing both even and odd harmonics.

A first system for converting square wave signals, which contain only odd harmonics, into a pulse waveform of a shape which contains both even and odd harmonics, is shown in FIG. 2, the illustrated circuit being for a single note of a musical instrument. Signals 50 of square waveform from a frequency synthesizer type of tone generator, for example, are applied to the base electrode of a transistor 52 (which may actually be the output stage of the frequency synthesizer), the emitter electrode of which is grounded. The circuit is so arranged that when the pulse signal 50 is at its upper level transistor 52 will saturate thereby, in effect, connecting the collector of the transistor to ground through the collector-emitter junction. In essence, the collector-to-emitter junction of the transistor is a switch that is alternately opened and closed in accordance with the low or high level, respectively, of the square wave signal 50. A gating circuit for the single note represented by signal 50 includes a keyswitch 58 of the associated key of the organ keyboard, a keying supply voltage represented by the battery 60, and an attack determining resistor 62 and an envelope capacitor 64. When the keyswitch 58 corresponding to a given note is closed, the capacitor 64 is charged through resistor 62 with a time constant determined by the values of resistor 62 and capacitor 64, corresponding to the attack of the musical sound. The voltage developed across capacitor 64 is applied through resistor 66 to the collector of transistor 52 which, as was noted earlier, is alternately connected to ground in response to the square wave signal 50. Consequently, the voltage at the collector of transistor 52 is chopped to produce a square wave signal 68 of the same frequency as the square wave signal 50. The signal appearing at the collector of transistor 52 is applied to a differentiating circuit consisting of resistor 70 connected in series with a relatively small capacitor 72, and a resistor 74 is connected from one terminal of the capacitor to ground, thereby producing across resistor 74 a voltage having the waveform shown at 76 which, because of its symmetrical positive and negative-going excursions, contains only odd harmonics. If the waveforms 76 were acoustically reproduced it would sound something like a square wave signal except that it would be brighter because its upper harmonics would be emphasized at the expense of the lower harmonics, but would still be hollow in character. To achieve a waveform containing even as well as odd order harmonics, the signal 76 is applied to a diode 78 connected to pass only the positive-going excursions of the signal, thereby to produce at an output terminal 80 sharp, narrow pulses 82 which have both even and odd harmonics. The pulse differs from a sawtooth wave in that it has essentially all the harmonics, at least all of the significant lower ones, at almost equal amplitude, only dropping off gradually at higher harmonic orders. Thus, the pulse produces a much brighter sound and has stronger harmonics than does a sawtooth wave in which the amplitude of the harmonics drop off at the rate of 6 dB per octave. The output terminal 80 is connected to an output bus 84 to which eleven other similar gating circuits, one for each of the other notes in a given octave, would be connected.

The pulse shape produced by the system of FIG. 2 is useful for producing reed voices and certain string voices, but is much too bright and therefore not a good waveform for producing diapason and flute sounds because of the amount and difficulty of filtering required to achieve the proper sound. A sawtooth waveform, on the other hand, is closer to a diapason sound, but, as has been noted above, does not have enough harmonics to produce a satisfactory reed sound. Rather than converting the waveform 82, which has the noted desirable harmonic makeup for reed and string sounds, into other wave shapes by extreme filtering as would be suggested by usual previous organ design practice, the pulse waveform 82 is instead again converted into a different pulse shape the harmonic makeup of which is such that it can with less severe filtering than heretofore required, be modified so as to have the requisite waveform for producing diapason, cello and flute sounds. More particularly, the invention contemplates the use of the waveform 82 as is for deriving, by filtering, voice signals for certain of the organ stops, and converting the narrow pulses 82 by integration into sawtooth waveform pulses which may readily be filtered to produce voicing signals for the cello, diapason and open flute stops, for example. Thus, with a recognition of the type of waveform that is needed to derive a particular organ voice with a minimum of filtering, it is possible, starting with a square wave signal from a tone generator, to make available in the same instrument pulses having additional different waveforms, one of which is particularly amenable for the derivation of of some stop tones and the other of which is more desirable for deriving other organ voices. The integration is preferably performed with operational amplifiers which change the relative amplitude of all the harmonics contained in the applied signal by a full 6 dB per octave throughout the audio frequency rage of interest, and also, always shift the phase of all harmonics of interest contained in the applied signal by substantially 90° regardless of the shape of the applied wave. Thus and operational amplifier integrating circuit (which may be characterized as a filter) has very different characteristics than the normal low- or high-pass filter, the phase shifts of which vary over a wide range and depend on the adjustment of their cutoff frequencies and the frequencies of the partials contained in the applied signal. Although it is known to use operational amplifiers as integrators or as differentiators, they have not, to Applicant's knowledge, been utilized in an organ voicing system in the manner now to be described.

As is well-known, an operational amplifier is a direct-coupled device with differential inputs and a single-ended output, the amplifier responding only to the difference voltage between the two input terminals, not to their common potential. A positive-going signal at the inverting input terminal produces a negative-going signal at the output, whereas the same signal at the noninverting input terminal produces a positive-going output. The open loop gain of the amplifier is extremely high, its operating characteristics being determined largely by the nature and arrangement of feedback elements connected between the output terminal and the inverting input terminal. The enormous gain of the operational amplifier permits it to be connected as a true integrating circuit which is operative to produce a 6 dB per octave filtering effect over the complete audio spectrum and still have usable gain from the input to the output, even at the highest frequency of interest. The present invention depends for its practical realization on the properties of the operational amplifier and its availability in integrated circuit form at low cost.

Figures 3, 3A, 3B:
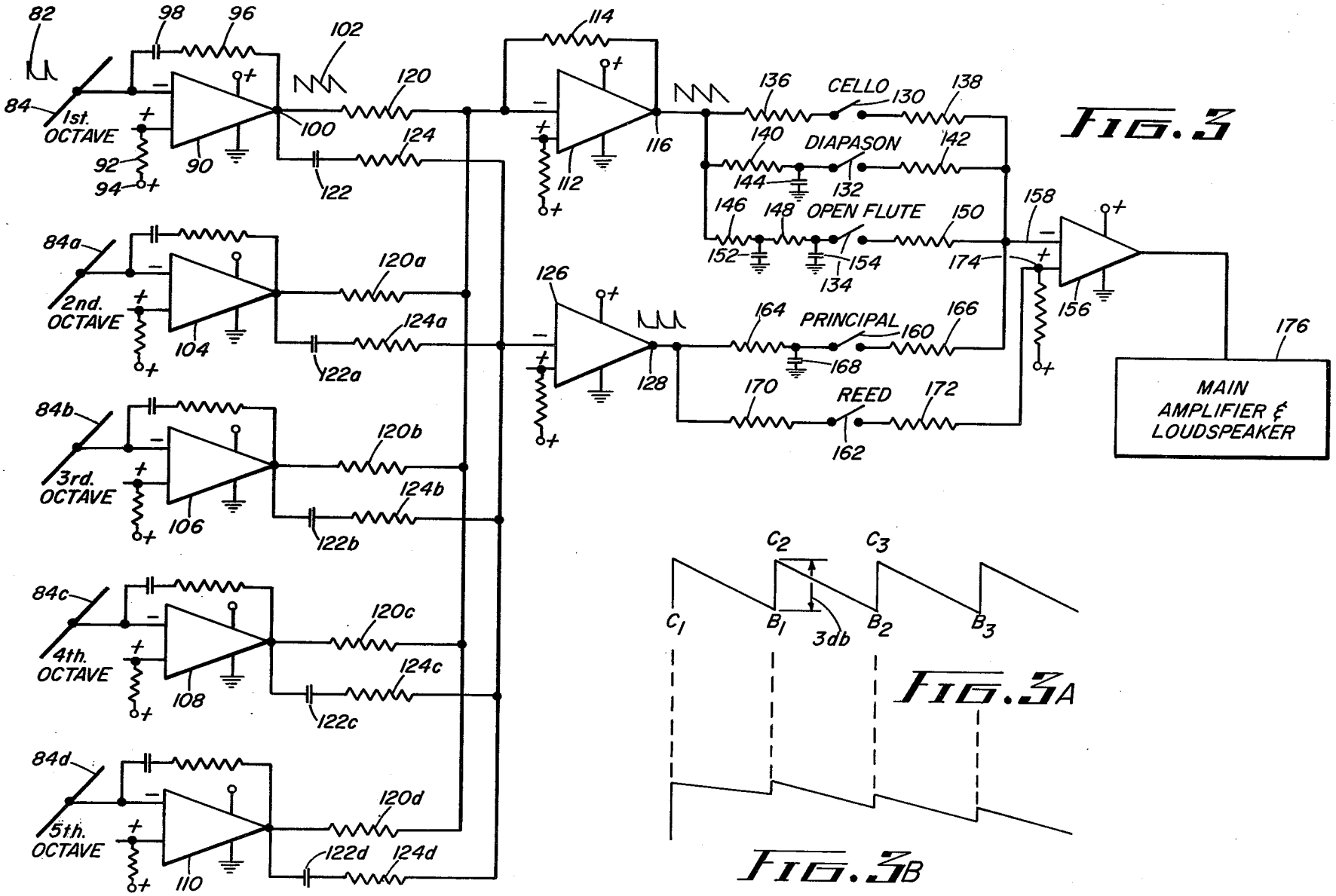
FIG. 3 is a schematic diagram of a first voicing system embodying the principles of the invention.
FIGS. 3a and 3b are waveforms used in explaining the operation of the system of FIG. 3.

Turning now to FIG. 3, pulses having the waveform 82, collected on the bus 84 from one octave of the organ, which for reference will be designated the first octave, are applied to the inverting input terminal of a first operational amplifier 90, the noninverting input of which is connected through a resistor 92 to a source of biasing potential represented by terminal 94. Thus, whatever keys of the keyboard within the first octave are played, the narrow pulses 82 of a frequency corresponding to the played note are applied to the inverting input terminal of the operational amplifier. A feedback network including a resistor 96 and a capacitor 98 is connected between the output terminal 100 and the inverting input terminal, the values of resistor 96 and capacitor 98 being so chosen that the rolloff slope of minus 6 dB per octave is determined almost entirely by the reactance of capacitor 98. Thus, the operational amplifier and the feedback network becomes an integrating circuit which produces at its output a pulse waveform 102 of a sawtooth shape in response to the narrow pulses 82 applied to the inverting input terminal, the sawtooth wave having a 6 dB per octave spectrum tilt over the audio spectrum of interest, namely, between the lowest and the highest frequency of the first octave. It will be apparent that if the lowest note applied to bus 84 is note C and the highest note is note B, which is slightly less than twice the frequency of note C, the amplitude of the sawtooth waveform 102 resulting from an input signal 82 corresponding in frequency to note B would have an amplitude slightly less than half that of the sawtooth produced by input pulses 82 corresponding in frequency to note C. Thus, if it is assumed that the input pulses corresponding to notes C and B are of the same amplitude, there will be a 6 dB difference in amplitude of the resulting sawtooth waveform. It being difficult to discern differences in amplitude of as much as about 3 dB, the values of the components of the elements of the gating circuit of FIG. 2 are preferably selected to preemphasize the upper frequencies of a given octave by about 3 dB relative to the lowest note in the octave so that the sawtooth waves produced at the output terminal 100 of the operational amplifier will all be within 3 dB of being of constant amplitude, with the amplitude of the higher frequency sawtooth signals slightly lower than those produced by the lower frequency notes.

Because of the 6 dB per octave rolloff characteristic of the integrator, it is evident that if one attempted to apply all of the notes throughout the range of the keyboard to a single integrator, the highest would be so greatly suppressed relative to the low frequency signals as to render the system impractical. Accordingly, a separate integrator is used for each octave; thus, in the five-octave system illustrated in FIG. 3, four additional operational amplifiers 104, 106, 108 and 110 are connected to receive at their inverting input terminal the notes collected on buses 84*a*, 84*b*, 84*c* and 84*d*, from the second, third, fourth and fifth octaves, respectively. These additional operational amplifiers each have a feedback circuit which includes a capacitor whose reactance is selected to give a rolloff slope of 6 dB per octave over its frequency range of interest. Accordingly, each of the operational amplifiers produces at its output terminal, in response to the sharp pulses 82 applied at the inverting terminal, a sawtooth waveform signal of corresponding frequency.

It being a characteristic of an operational amplifier that its output impedance is very low, the output terminal 100 can be regarded as a low impedance source of the sawtooth wave 102. The inverting input terminal of an operational amplifier also has very low impedance, making it an ideal mixing amplifier for mixing the output signals from the five operational amplifiers 90, 104, 106, 108 and 110, an operational amplifier 112 being provided for this purpose. The gain of the mixing amplifier 112 is controlled by a feedback network consisting of a resistor 114 connected between its output terminal 116 and its inverting input terminal, being set at a value such that with as many notes played as one would ever likely want to play on the keyboard, the output signals at terminal 116 would not overload the amplifier but yet be as high in amplitude as the power supply voltage would permit. By virtue of the low impedance at the output terminal of each of the integrating operational amplifiers and the low impedance of the input terminal of mixing amplifier 112, the amplitude of the signal mix is proportional only to the resistance of the mixing resistors 120, 120*a*, 120*b*, 120*c* and 120*d* connected between the output terminals of operational amplifiers 90, 104, 106, 108 and 110 and the inverting input terminal of mixing amplifier 112. That is, if the resistance of resistor 120 is doubled, the signal coupled from integrator 90 to the mixing amplifier 112 would be halved. Since within a given octave the amplitude of the sawtooth 102 tends to become slightly lower as one goes up the scale, the resistors 120, 120*a*, 120*b*, 120*c* and 120*d* may have slightly different values, and by proper selection it is possible to balance or adjust the level at the break point between octaves to that instead of the output levels shown in FIG. 3A, one would obtain output levels represented by the curve of FIG. 3B.

It is evident from the description thus far that with a relatively limited number of operational amplifier integrating circuits, one for each octave of the keyboard, the narrow pulses 82 can be converted to sawtooth waves wherein the smoothness and the differences of the notes from one to another, are always within narrow limits. As will be described later, the sawtooth waveform signals are suitably filtered to produce those organ voices that are most readily derived from a sawtooth waveform signal. Reed voices and some string voices being best derived from sharp, narrow pulses, such as those derived from the circuit of FIG. 2, it is a feature of the invention to make pulses of this shape available for application to suitable filter networks for deriving such voices. Although it would be possible to connect an operational amplifier to each of the buses 84, 84*a*, 84*b*, etc., to gather the sharp pulse signal appearing thereon, because of the low input impedance of the operational amplifier there would be signal distortion due to interaction of signals appearing on the buses. It has been found more convenient to, instead, derive pulses having a waveform substantially the same as that of the pulses 82 by differentiating the sawtooth wave signals appearing at the output terminals of operational amplifiers 90, 104, 106, 108 and 110. To this end, the sawtooth signal 102 at the output terminal 100 of operational amplifier 90 is applied to a differentiating circuit consisting of a capacitor 122 connected in series with a resistor 124, and thence to the inverting input terminal of an operational amplifier 126. Since the output terminal 100 of operational amplifier 90 is a low impedance point, as is the inverting input terminal of operational amplifier 126, the current flowing from amplifier 90 to amplifier 126 is proportional to the impedance of the interconnecting circuit, and if the impedance is determined primarily by the reactance of the capacitor, the current will be higher at the higher frequencies. Resistor 124 has relatively low value, selected to limit the differentiating effect to the frequencies of interest, and to prevent the very high order harmonics beyond the range of musical interest to be applied to the mixing amplifier 126. Thus, by proper selection of the values of capacitor 122 and resistor 124, the differentiating circuit will introduce a 6 dB per octave spectrum tilt and the output signal from the mixing amplifier 126 will have substantially the shape of the pulses 82 originally applied to the integrator. A similar differentiating circuit is connected between the output terminal of each of the other operational amplifier integrators 104, 106, 108 and 110 and the inverting input terminal of mixing amplifier 126, the value of the capacitor in each being selected to adjust the scaling of the individual octaves and to achieve signals at the output terminal 128 of the mixing amplifier or relatively uniform amplitude, desirably within 3 dB throughout the range of the instrument.

It is thus seen that the single waveform output of the tone generating system of FIG. 2 has been converted into two additional different waveforms of the same frequency, one of sawtooth shape and the other a sharp narrow pulse, having drastically different tonal characteristics, yet, because the integrators introduce a phase shift of 90° to all frequencies contained in the signals applied thereto and the differentiating circuit likewise introduces a phase shift of 90°, the phase relationship between the fundamental and other partials of the sawtooth waveform signals at the output terminal 116 of mixing amplifier 112 and the fundamental and other partials of the sharp pulse waveform at the output terminal 128 of mixing amplifier 126 are always within substantially 90°. The phase difference cannot be more than 90° and it will hardly ever by significantly less than 90°; this known phase difference is very important in the subsequent processing of the signals.

It will now be evident that when the organ is played, the played notes will appear as sawtooth wave signals at terminal 116 and as sharp pulse signals at terminal 128. It being known that a sawtooth waveform signal has an harmonic content that permits its modification by filtering to produce cello, diapason and open flute sounds, the sawtooth signal at output terminal 116 is applied to three parallel-connected filter networks having cello, diapason and open flute stop switches 130, 132 and 134, respectively. The cello "filter" is a purely resistive network consisting of resistors 136 and 138, the diapson filter is a one-stage, low-pass filter including series-connected resistors 140 and 142 and a capacitor 144 connected to ground, and the open flute filter is a two-stage, low-pass filter including series-connected resistors 146, 148 and 150 and capacitors 152 and 154 connected to ground from the junction of resistors 146 and 148 and the junction of resistors 148 and 150 to ground, respectively. The output terminals of the three filters are connected together and to a mixing preamplifier, which preferably takes the form of an operational amplifier 156, with the output terminals of the filters connected to its inverting input terminal 158. The low-pass diapason filter alters the structure of the applied sawtooth wave and at the higher frequencies will introduce a phase shift of 90° maximum with respect to the cello signals. Since two signals that differ in phase by 90° are neither additive nor subtractive, there is no undesirable signal cancellation when the cello and diapason stops are played together. The two-stage open flute filter introduces a maximum phase shift of 180° with respect to the unfiltered cello sawtooth wave, but the 180° phase shift will occur only at high frequencies where capacitors 152 and 154 present a very low impedance relative to the resistors 146, 148 and 150. While it is possible that the simultaneous playing of the cello and flute stops can involve some signal cancellation due to the 180° phase difference, the problem is relatively minor because the harmonics that are shifted by 180° are so attenuated by the filter action that they do not substantially subtract from the corresponding harmonics in the cello sound.

The narrow pulses appearing at output terminal 128 of the mixing amplifier 126, which have an harmonic structure amenable for the derivation therefrom of reed sounds, are applied to two other filter networks, a first of which includes a PRINCIPAL stop which 160 and the other of which includes a REED stop switch 162. The PRINCIPAL filter is a low-pass filter including resistors 164 and 166 and a capacitor 168 that modifies the pulse wave to produce a tone somewhat similar to but yet quite different from that of the cello. Since the PRINCIPAL sound is derived from the pulse waveform and because the low-pass filter begins to roll off at a much higher frequency than do the integrating circuits 90, 104, etc., that produced the sawtooth waves from which the pulse signal was derived by differentiation, the low-order harmonics are more nearly of the same amplitude in the case of the PRINCIPAL as compared to the harmonic structure of the cello sound. While some phase cancellation can occur between the PRINCIPAL and open flute signals, experience has shown that the cancellation is minimal and that the output signals from the PRINCIPAL filter can therefore be mixed with the cello by connecting the output of the PRINCIPAL filter to the inverting terminal 158 of mixing operational amplifier 156.

The reed filter, a purely resistive network of series connected resistors 170 and 172, does not introduce any phase shift to the applied pulse signals, and because the action of the differentiating circuits 122, 124 causes the pulse wave at the output of amplifier 126 to be displaced in phase by 90° with respect to the sawtooth waveform signal at the output terminal of mixing amplifier 112, if the reed signal were mixed with the cello, diapason and open flute signals, there would be severe cancellation of many of the harmonic partials when the reed and diapason stops were drawn simultaneously, or when the reed and open flute stops were simultaneously played, or when all three of the stops were drawn simultaneously. This difficulty is conveniently avoided, however, by connecting the output terminal of the reed filter to the non-inverting terminal 174 of the operational amplifier 156. By applying the reed signal to the non-inverting terminal it cannot subtract with the diapason signal, and in fact, they will be in phase at the higher frequencies and will have a 90° phase relationship at low and mid-frequencies. Similarly, there will be only slight phase cancellation problems between the reed and open flute signals, and then only at the very high frequencies where the low-pass open flute filter sharply attenuates the upper partials; the effect, however, is almost unnoticeable. The output terminal of the mixing operation amplifier 56 is connected to the main organ amplifier and loudspeaker system represented by the block 176.

Figure 4:
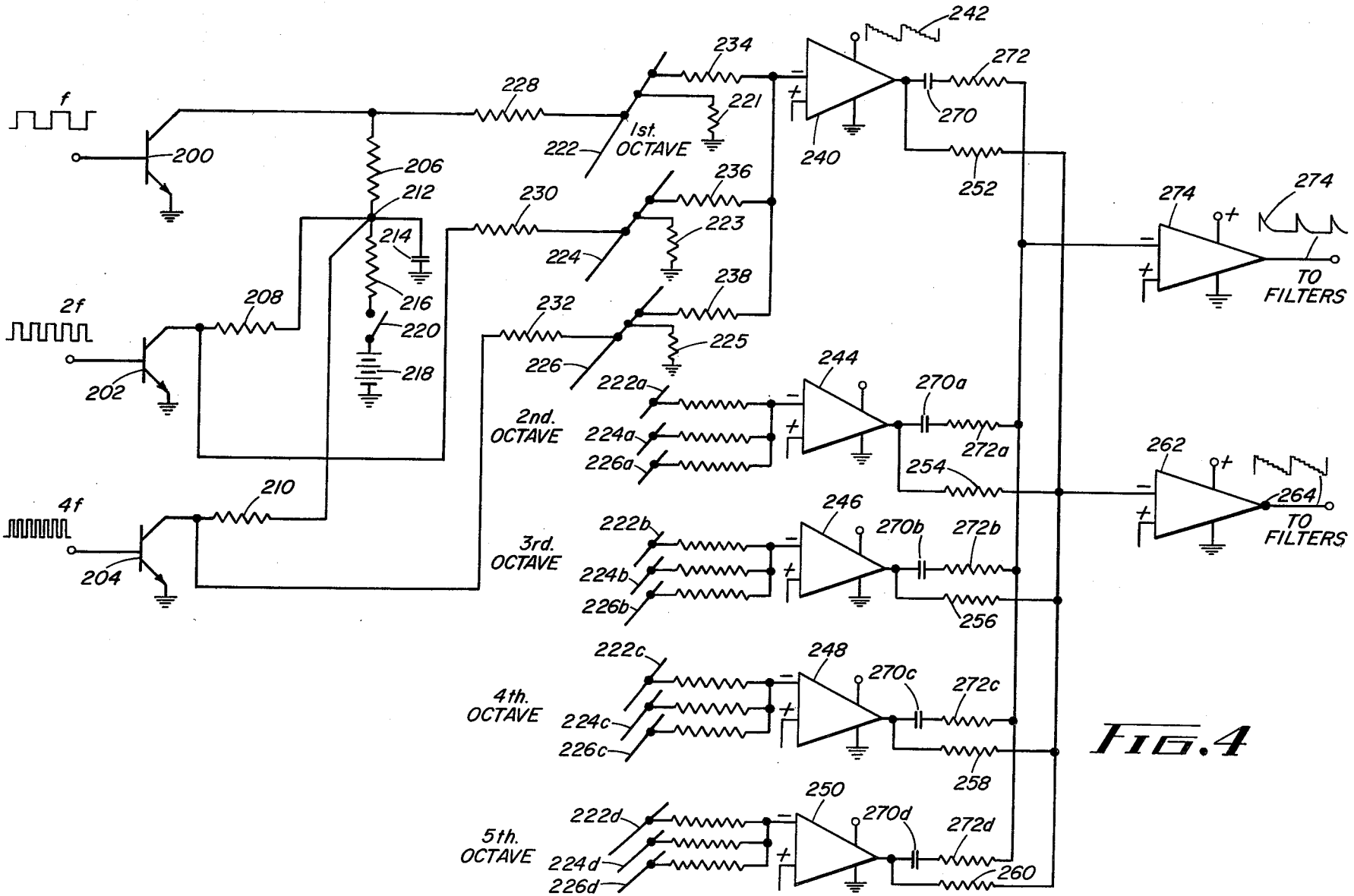
FIG. 4 is a schematic diagram of an alternate form of a voicing system embodying the invention.

Referring now to FIG. 4, there is shown an alternate form of voicing system incorporating the principles of the invention wherein the "stairstepping" technique is utilized to initially synthesize a sawtooth waveform from the square wave signals generated by a conventional tone generator. Since the sawtooth waveform synthesis depends for its operation on the addition of appropriate proportions of square waves of a fundamental frequency, twice the fundamental and four times the fundamental, the signals to be added are necessarily phase-locked; thus the generator must be of the locked octave type. The square wave signal of frequencies $f$, $2f$ and $4f$ are applied to the base electrode of switching transistors 200, 202 and 204, respectively, the emitter electrode of each of which is connected to ground as shown. The collector electrodes of transistors 200, 202 and 204 are connected through respective resistors 206, 208 and 210 to a common junction 212, to which an RC time constant circuit including a capacitor 214 and a resistor 216 are also connected. A source of keying supply voltage represented by the battery 218 is connected to the time constant circuit upon closure of a keyswitch 220 which corresponds to a switch under one of the keys of the organ keyboard. It will be recognized that this circuit, of which there is one for each note of the keyboard, is similar to the gating circuit of FIG. 2 except that it includes three transistors instead of one, the envelope circuit, however, being common to the three transistors. As in the system of FIG. 2, each of the transistors is arranged so as to be saturated when the respective applied square wave signals are at their upper level, thereby to cause the collector to be connected to ground through the collector-emitter junction. When the keyswitch 220 is closed, the voltage from battery 218 charges the capacitor 214 through resistor 216, and square wave signals corresponding to the three input signals appear on respective output buses 222, 224 and 226 each with an attack characteristic depending on the time constant of resistor 216 and capacitor 214. Similarly, when the keyswitch is opened, the notes will decay smoothly as the charge on capacitor 214 gradually diminishes and fades out. The square wave signals are coupled to the respective buses through resistors 228, 230, and 232. Each bus has a load resistor 221, 223 and 225, respectively, connected to ground. It will be appreciated that eleven others of the described gating circuits for the remaining notes of the first octave would be similarly connected to the output buses 222, 224 and 226, and that twelve such gating circuits would be required for each of the other octaves of the organ, the output buses for the four additional ocaves being shown at *222a, 224a, 226a, 222b, 224b* and *226b*, and so on.

The square wave signals appearing on buses 222, 224 and 226 are combined in a resistor network consisting of resistors 234, 236 and 238 and applied to the inverting input terminal of a mixing operational amplifier 240. Resistor 236 has a resistance substantially twice that of resistor 234, and resistor 238 has a value twice that of resistor 236 (or four times that of resistor 234) in order that the three square wave signals will be mixed in order that the three square wave signals will be mixed in the proper proportions to produce the desired stairstep wave 242, simulative of a sawtooth waveform, at the output terminal of the mixing amplifier 240. The three square wave signals appearing at the three buses for the other octaves are similarly combined and applied to the inventing input terminal of respective operational amplifiers 244, 246, 248 and 250. Thus, stairstep waveforms similar in shape to that of 242, but of progressively higher frequency, appear at the output terminals of these other operational amplifiers. The output terminal of operational amplifiers 240, 244, 246 and 250 are all connected through respective resistors 252, 254, 256, 258 and 260 to the inverting input terminal of an operational amplifier 262 so as to deliver at the output terminal 262 a stairstep signal of substantially sawtooth waveform of a frequency corresponding to the note being played. As in the system of FIG. 3, to compensate for the fact that within a given octave the notes tend to be of slightly lower amplitude as one goes up the scale, the values of resistors 252, 254, 256, 258 and 260 are selected such that the stairstep waveform is of substantially uniform amplitude throughout the range of frequencies of the organ. The synthesized sawtooth waveform appearing at the output terminal 264 of amplifier 262 is the musical equivalent of the sawtooth voltage that appears at the output terminal 116 of the operational amplitude 112 of FIG. 3, and thus may be used with similar filtering to produce cello, diapason and open flute voices.

Using circuitry similar to that employed in the system of FIG. 3 for deriving sharp pulses from the sawtooth waveform signal, the synthesized waveform signals appearing at the output terminals of amplifiers 240-250 are differentiated to produce narrow pulse signals useful, for example, for the production of reed and certain string voices. More particularly, taking advantage of the low impedance of both the output and input of an operational amplifier whereby the current flowing between the output of one and the input of the other is proportional to the impedance of the connecting path, the output terminal of amplifier 240 is connected through a differentiating circuit consisting of a capacitor 270 connected in series with a resistor 272 to the inverting input terminal of an operational amplifier 274. The capacitor 270 has a value such as to give a 6 dB per octave spectrum tilt thereby to cause the output signals from the amplifier 274 to be sharp pulses as indicated at 276, which pulses although having small spikes at each step are musically equivalent to the sharp pulses appearing at the output terminal 128 of the amplifier 126 in the FIG. 3 system. The output terminal of the other four operational amplifiers are connected through similar differentiating circuits to the inverting input terminal of amplifier 274. By proper selection of the values of the capacitors, which primarily determine the impedances between the output of each of the five operational amplifiers and the input of the mixing amplifier 274, the scaling of the individual octaves can be adjusted to achieve output signals of relatively uniform amplitude, at least within 3 dB throughout the whole range of the instrument. The sharp pulses 276 and the synthesized sawtooth waveform at the output terminal 264 of amplifier 262 are in the same relative phase relationship as the corresponding signals are in the system of FIG. 3, and therefore, after filtering in the networks arranged as shown in FIG. 3, can be combined in the operational amplifier in the same way as was described in connection with FIG. 3.

Figure 5:
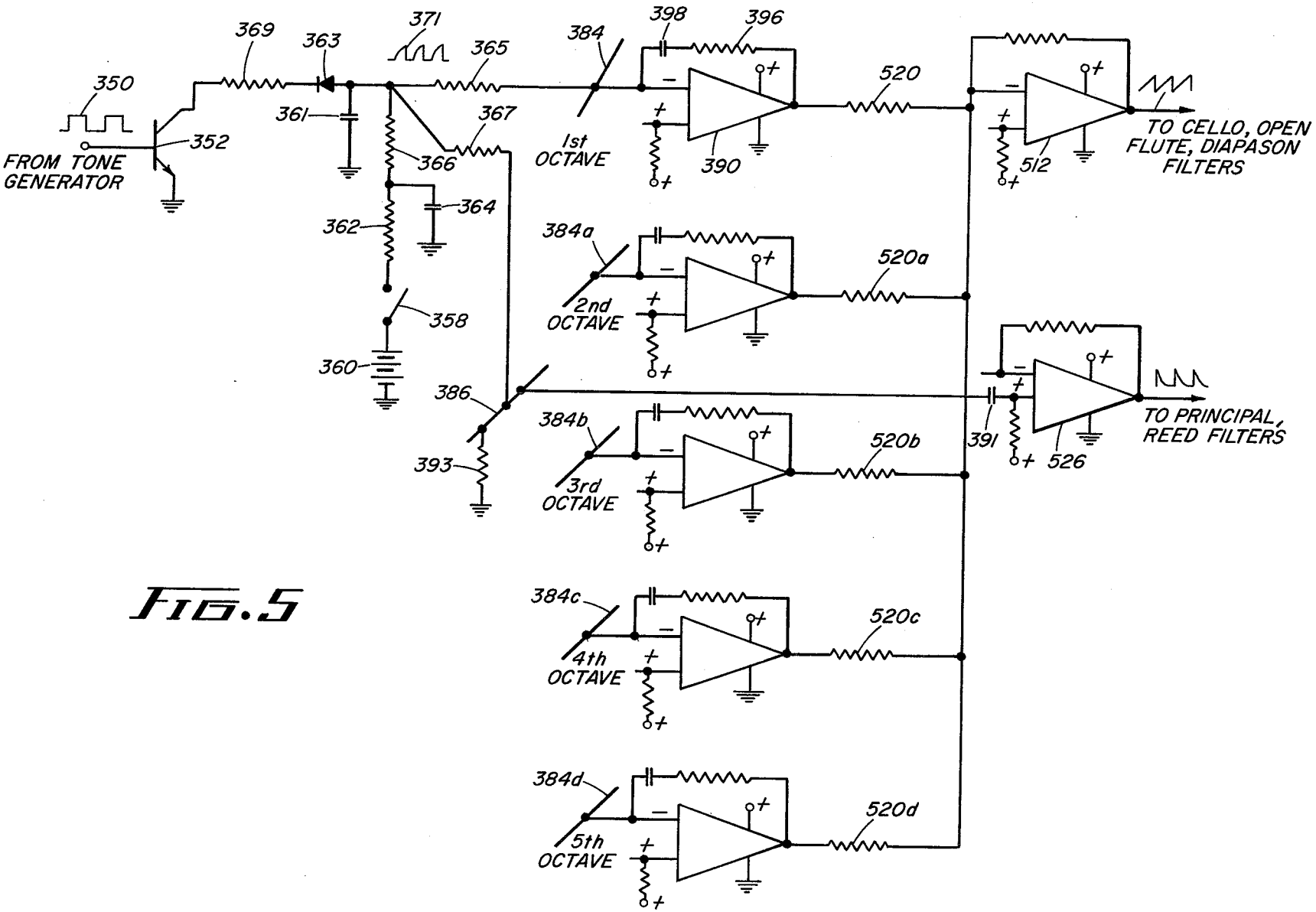
FIG. 5 is a circuit diagram of still another voicing system which utilizes a novel gating and pulse-forming system for converting square wave signals to sharp pulses containing both even and odd harmonics.

In the embodiments described above, it is necessary to accept compromises in scaling to within about 3 dB, assuming that the tone signals are processed in one-octave groups. In this connection, it will be understood that the described one-octave group processing is by way of example only, and groups having more or less than an octave of notes can be processed in a similar manner. FIG. 5 shows an alternate form of the invention which makes it possible to obtain from a square signal two (or more) additional waveforms, each containing both even and odd harmonics, and in which each output can be scaled exactly as desired. The system of FIG. 5, like that of FIG. 2, does not require locked octave square wave forces for proper operation.

Referring now to the circuit of FIG. 5, a square wave signal 350 from a suitable source is applied to the base electrode of a switching transistor 352, the emitter of which is grounded. The circuit is so arranged that when signals 350 is at its upper level the transistor 352 will saturate, thereby, in effect, connecting the collector of the transistor to ground through the collector-emitter junction. A gating circuit for the single note represented by signal 350 includes a keyswitch 358, a keying supply voltage represented by the battery 360, an attack determining resistor 362, and an envelope capacitor 364. When the keyswitch 358 is closed, the envelope capacitor 364 is charged through resistor 362 with a time constant determined by the values of resistor 362 and capacitor 364, corresponding to the attack of the musical sound. During the time that the input wave 350 is low, transistor 352 will look like an open switch, and a pulse-forming capacitor 361, one terminal of which is grounded, will charge through resistor 366. When the input wave 350 goes high, transistor 352 saturates and discharges capacitor 361 through a diode 363 and a current-limiting resistor 369. Thus, a signal 371 consisting of relatively sharp, narrow pulses, which contain both even and odd harmonics, is formed at junction 373. Junction 373 is connected via a resistor 365 to a bus-bar 384, which in turn is connected to the inverting input terminal of an operational amplifier 390, it being understood that bus-bar 384 is common to a plurality of gates, in this case twelve. Since the output voltage of an operational amplifier is proportional to its input current, the output amplitude of each note is determined, inter alia, by the value of resistor 365.

Junction 373 is also connected through a resistor 367 to a bus-bar 386, which, in turn, is connected through a capacitor 391 to the noninverting input terminal of an operational amplifier 526. A load resistor 393 is connected from bus-bar 386 to ground. Bus-bar 386 may be common to all of the notes of the instrument. The resistors 367 associated with the individual gates may be selected or adjusted to provide any desired scaling of notes appearing at the output of operational amplifier 526. The signals at the output of this amplifier are pulse waves that correspond musically to the output pulses from operational amplifier 126 in the FIG. 3 system or the output pulses from operaional amplifier 274 in the system of FIG. 4.

The pulses appearing on bus-bar 384 are applied to the inverting input terminal of operational amplifier 390, having a feedback network consisting of a resistor 396 and a capacitor 398 which, as explained in connection with FIG. 3, converts the operational amplifier into an integrating circuit which causes a 6 dB per octave spectrum tilt at its output.

Similar operational amplifier integrators are connected to the output bus-bars 384*a*, 384*b*, 384*c* and 384*d* for the other octaves of the instrument. The output signals from the integrators are combined by means of resistors 520, 520*a*, 520*b*, 520*c* and 520*d* and applied to the inverting input terminal of an operational amplifier 512 having a resistive feedback network. The resistors 520, 520*a*, etc. may for convenience have identical values. It is most convenient in this embodiment to adjust the relative amplitudes of the notes appearing at the output terminal of operational amplifier 512 by adjusting or selecting the values of the resistors 365 associated with the individual notes. A major advantage of the described gating circuit is that two (or more) output signals can be simultaneously derived, each with its own predetermined scaling. In the example shown, it would be typical to adjust the resistors 365 so that the highest note in a given octave would produce a signal at bus-bar 384 that is about 6 dB greater in amplitude than that produced by the lowest note of that octave, so as to counteract the 6 dB per octave spectrum tilt introduced by the integrator for that octave.

It is seen from the foregoing described that there is provided a voicing system operative in response to squarewave pulses from a tone generator for initially transforming the square wave signals to another wave shape more suitable for producing certain organ voices. In the first embodiment, the square wave pulses are converted to sharp pulses and in the second embodiment they are synthesized by the known "stairstepping" technique to produce a sawtooth waveform. In the first embodiment, the sharp pulses are converted to sawtooth pulses by integration to be available for production of certain organ voices, and the sawtooth pulses are differentiated to again produce the sharp pulses for the derivation of other organ voices. In the second embodiment, the synthesized sawtooth waveform signals are used directly and similar sharp pulses are obtained by differentiating the synthesized sawtooth waveform. In a third embodiment, a gating circuit is shown whose outputs can be conveniently scaled so that when used with integrating or differentiating circuits as taught by the invention, produce a plurality of distinctively different waveforms, each of which can be scaled exactly as desired. Thus, in each of the systems, both sawtooth waves and narrow pulse signals are available, both having been initially derived from square wave pulses generated by conventional tone generators. In the process of conversion from one wave shape to another, either a differentiating circuit or an integrating circuit produces a known phase shift of 90° regardless of the partial and regardless of the frequency of the note applied to the circuit, this feature enabling the combining of several voice signals in such a way as to avoid undesirable cancellation of certain harmonics when more than one stop is played simultaeneously.

Although the invention has been described in connection with several illustrative embodiments, it will now be obvious to ones skilled in the art how the invention can be adapted to other applications or systems by applying one or more of the disclosed principles or features. For example, it is entirely possible to modify narrow pulse waves into still narrower pulse waves by additional cascaded differentiators, or to convert sawtooth waves to waves having still less harmonic content by subjecting them to additional integration. In each case, proper scaling can be restored by suitable preemphasis. Furthermore, the concept of preemphasis and integration, or preemphasis and differentiation, can be used in connection with square wave signals having odd order harmonics only in order to obtain other odd order harmonic only waveforms having different relative harmonic amplitudes.

I claim:

1. In a voicing system for an electronic musical instrument including sources of square wave signals having frequencies corresponding to the notes of a musical scale, apparatus for deriving from said square wave signals by operation of playing keys first and second other pulse signals of different wave shapes, both differing from a square wave, said apparatus comprising, in combination:

a plurality of player-operated keyswitches, means including gating means connected to said sources of square wave signals for producing in response to actuation of a keyswitch a first other pulse signal of frequency corresponding to the actuated keyswitch, means including a plurality of bus-bars each for gathering the first other pulse signals of frequencies corresponding to a selected multiplicity of notes, a plurality of circuit means equal in number to the number of bus-bars connected one each to receive the first other pulse signals gathered at a different one of said bus-bars and operative to convert said first other pulse signals to second other pulse signals, having a different waveform, each of said circuit means being operative to produce substantially a 6 dB per octave filtering effect throughout the range of frequencies of the first other pulse signals applied thereto and to shift the phase of all harmonics of interest contained therein by substantially 90°, a first mixing amplifier having input and output terminals, and means for coupling all of said circuit means to the input terminal of said first mixing amplifier whereby to produce at its output terminal second other pulse signals of frequency corresponding to the played notes.

2. Apparatus according to claim 1, wherein said first other pulse signals have a sharp pulse waveform containing both odd and even order harmonics, and wherein each of said plurality of circuit means comprises an integrating circuit for converting the sharp pulse waveform signals to second other pulse signals having a sawtooth waveform.

3. Apparatus according to claim 2, wherein each of said integrating circuits comprises an operational amplifier having an inverting input terminal to which said sharp pulse waveform signals are applied, and an output terminal from which a feedback network including capacitive reactance is connected to said inverting input terminal.

4. Apparatus according to claim 3, wherein said first mixing amplifier is an operational amplifier having an inverting input terminal providing a low impedance and an output terminal, and wherein the output terminal of each of said integrator operational amplifiers is connected by a respective resistive network to the inverting input terminal of said first mixing amplifier, said resistive networks having resistance values such that the sawtooth waveform signals produced at the output terminal of said first mixing amplifier are of substantially uniform amplitude throughout the frequency range of the musical instrument.

5. Apparatus according to claim 1, wherein said first other pulse signals have a synthesized sawtooth waveform containing both odd and even order harmonics, and wherein each of said plurality of circuit means comprises a differentiating circuit for converting the synthesized sawtooth waveform signals to second other pulse signals having a sharp pulse waveform.

6. Apparatus according to claim 5, wherein each of said differentiating networks includes a capacitor having an impedance value so as to produce substantially a 6 dB per octave filtering effect throughout the range of frequencies of the synthesized sawtooth waveform signals applied thereto and to shift the phase of all harmonics of interest contained therein by substantially 90°, and such that the sharp pulse signals produced at the output terminal of said first mixing amplifier are scaled to have predetermined relative amplitudes.

7. Apparatus according to claim 4, further including a second mixing amplifier, said second mixing amplifier being an operational amplifier having an inverting input terminal presenting a low impedance and an output terminal, and wherein the output terminal of each of said integrator operational amplifiers is connected by a different differentiating network to the inverting input terminal of said second mixing amplifier, each of said differentiating networks being operative to convert the sawtooth waveform signals applied thereto to sharp pulses of substantially the waveform of the sharp pulses applied to said integrator operational amplifiers.

8. Apparatus according to claim 7, wherein each of said differentiating networks include a capacitor having an impedance value so as to produce substantially a 6 dB per octave filtering effect throughout the range of frequencies of the sawtooth waveform signals applied thereto and to shift the phase of all harmonics of interest contained therein by substantially 90°, and such that the sharp pulse signals produced at the output terminal of said second mixing amplifier are scaled to have predetermined relative amplitudes.

9. In a voicing system for an electronic musical instrument including sources of square wave signals having frequencies corresponding to the notes of a musical scale, apparatus for deriving from said square wave signals by operation of playing keys first and second other pulse signals of different wave shapes, both differing from a square wave, and each useful for the production of selected different voice signals, said apparatus comprising, in combination:

a plurality of player-operated keyswitches, means including gating means connected to a source of square wave signals for producing in response to actuation of a keyswitch a first other pulse signal of frequency corresponding to the actuated keyswitch, means including a plurality of bus-bars each for gathering the first other pulse signals of frequencies corresponding to a selected multiplicity of notes, a plurality of integrating circuit means equal in number to the number of bus-bars connected one each to receive the first other pulse signals gathered at a different one of said bus-bars and operative to convert said first other pulse signals to second other pulse signals having a different waveform suitable for producing a first class of voice signals, each of said integrating circuit means being operative to produce substantially a 6 dB per octave filtering effect throughout the range of frequencies of the first other pulse signals applied thereto and to shift the phase of all harmonics of interest contained therein by substantially 90° in one direction, a first mixing amplifier having input and output terminals, means for coupling all of said integrating circuit means to the input terminal of said first mixing amplifier whereby to produce at its output terminal second other pulse signals of frequency corresponding to the played notes, a second mixing amplifier having input and output terminals, and a like plurality of differentiating circuit means, one connected between each of said integrating circuit means and the input terminal of said second mixing amplifier, each of said differentiating circuit means including a capacitor having an impedance value so as to produce substantially a 6 dB per octave filtering effect throughout the range of frequencies of the second other pulse signals applied thereto and to shift the phase of all harmonics of interest contained therein by substantially 90° in the opposite direction, whereby to produce at the output terminal of said second mixing amplifier pulse signals having a waveform differing from the waveform of said second other pulse signals for producing a second different class of voice signals.

10. Apparatus according to claim 9, further including a first filter network connected to receive and operative to modify said first other pulse signals from said first mixing amplifier to produce a first given organ voice signal, the said filter network being operative to shift the phase of at least some harmonics of an applied first other pulse signal by about 90°, a second filter network connected to receive and operative to modify said second other pulse signals from said second mixing amplifier to produce a different given organ voice signal, said second filter network producing no phase shift to an applied second other signal, a third mixing amplifier comprising an operational amplifier having inverting and noninverting input terminals and an output terminal, means for coupling the output signal from said first filter network to the inverting input terminal of said third mixing amplifier, and means connecting the output signal from said second filter network to the noninverting input terminal of said third mixing amplifier, whereby to minimize cancellation of corresponding harmonics of the output signals derived from said first and second filter networks when sounded simultaneously.

11. Apparatus according to claim 9, further including a first plurality of filter networks each connected to receive said second other pulse signals from said first mixing amplifier and each operative to produce therefrom a different organ voice signal, one of the filter networks of said first plurality causing no phase shift to an applied second other pulsue signal and a second of the filter networks of said first plurality being operative to shift the phase of an applied second other pulse signal by about 90°, a second plurality of filter networks each connected to receive said other pulse signals from said second mixing amplifier and each operative to produce therefrom a different organ voice signal, one of the filter networks of said second plurality causing no phase shift to an applied other pulse signal and a second of the filter networks of said second plurality being operative to shift the phase of at least some harmonics of an applied other pulse signal by about 90°, a third mixing amplifier comprising an operational amplifier having inverting and noninverting input terminals and an output terminal, means for coupling the output signals from the said one and said second filter networks of said first plurality and from the said second filter network of said second plurality to the inverting input terminal of said third mixing amplifier, and means for coupling the output signal from the said first filter network of said second plurality to the noninverting input terminal of said third mixing amplifier, whereby to minimize cancellation of corresponding harmonics of the output signals derived from the filter networks of said first and second pluralities, or any combination thereof, when sounded simultaneously.

12. Apparatus according to claim 11, wherein said first plurality of filter networks further includes a third filter network operative to shift the phase of at least some harmonics of an applied first other signal by about 180°, and further including means for coupling the output signal from the said third filter network of said first plurality to the inverting input terminal of said third mixing amplifier.

13. Apparatus according to claim 9, wherein said fist and second mixing amplifiers are both operational amplifiers having an inverting input terminal presenting a low impedance and an output terminal, wherein all of said integrating circuit means are connected to the inverting input terminal of the first operational amplifier, and wherein all of said differentiating circuit means are connected to the inerting input terminal of the second operational amplifier.

14. Apparatus according to claim 13, wherein each of said integrating circuit means comprises an operational amplifier having an inverting input terminal to which said first other pulse signals are applied, and an output terminal from which a feedback network including a capacitive reactance is connected to said inverting input terminal.

15. In a voicing system for an electronic musical instrument, the combination comprising:

means for producing first and second pulse signals of the same frequency but different wave shapes, each of which contains both even and odd harmonics and wherein partials of interest contained in said first pulse signals are displaced by substantially 90° with respect to corresponding partials contained in said second pulse signals, a first filter network connected to receive said first pulse signal and operative to modify the same to produce at its output a first voice signal, said first filter network being operative to shift the phase of at least some partials of an applied first pulse signal by about 90°, a second filter network connected to receive said second pulse signal and operative to modify the same to produce at its output a second different voice signal, said second filter network producing no phase shift to an applied second pulse signal, a mixing amplifier having inverting and noninverting input terminals and an output terminal, means for coupling the output signal from said first filter network to the inverting input terminal of said mixing amplifier, and means for coupling the output signal from said second filter network to the noninverting input terminal of said mixing amplifier, whereby to minimize cancellation of corresponding partials of the output signals derived from said first and second filter networks when sounded simultaneously.

16. Apparatus according to claim 15, further including a third filter network connected to receive said first pulse signal and operative to modify the same to produce at its output a third different voice signal, said third filter network being operative to shift the phase of at least some partials of an applied first pulse signal by about 180°, and means for coupling the output signal from said third filter network to the inverting input terminal of said mixing amplifier, whereby to minimize cancellation of corresponding partials of the output signals derived from said first, second and third filter networks, or any combination thereof, when sounded simultaneously.

17. Apparatus according to claim 16, further including, a fourth filter network connected to receive said second pulse signal and operative to modify the same to produce at its output a fourth different voice signal, said fourth filter network being operative to shift the phase of at least some partials of an applied second pulse signal by about 90°, and means for coupling the output signal from said fourth filter network to the inverting input terminal of said mixing amplifier, whereby to minimize cancellation of corresponding partials of the output signals derived from said first, second, third and fourth filter networks, or any combination thereof, when sounded simultaneously.

18. In a voicing system for an electronic musical instrument including sources of square wave signals having frequencies corresponding to the notes of a musical scale, apparatus for deriving from said square wave signals by operation of playing keys first and second other pulse signals of different wave shapes, both differing from a square wave, said apparatus comprising, in combination, a plurality of player-operated keys, means including a like plurality of gating means connected to said soruces of square wave signals for producing in response to actuation of a keyswitch a first other pulse signal of frequency corresponding to the activated keyswitch, said gating means each comprising, switching means operative to be closed and opened in response to the upper and lower levels, respectively, of a square wave signal from one of said sources, a source of direct current potential, a keyswitch and an RC time constant circuit, including a first resistor and a first capacitor, connected between said source of direct current potential and a circuit junction point, a second capacitor connected between said circuit junction point and a point of reference potential arranged to be charged from said source of direct current potential when said switching means is open, and a diode connected between said circuit junction point and said switching means arranged to discharge said second capacitor when said switching means is closed, whereby to produce at said circuit junction point a first other pulse signal differing from a square wave and containing both odd and even harmonics and of a frequency corresponding to the actuated keyswitch, means including a plurality of bus-bars for gathering the first other pulse signals produced at said circuit junction point of frequencies corresponding to a multiplicity of notes, a plurality of integrating circuit means, equal in number to the number of bus-bars, connected one each to receive the first other pulse signals gathered at a different one of bus-bars and operative to convert said first other pulse signals to second other pulse signals having a substantially sawtooth waveform, each of said integrating circuit means being operative to produce substantially a 6dB per octave filtering effect throughout the range of frequencies of the first other pulse signals applied thereto and to shift the phase of all harmonics of interest contained therein by substantially 90°, a first mixing amplifier having input and output terminals, means for connecting all of the integrating circuit means to the input of said first mixing amplifier whereby to produce at its output terminal second other pulse signals of frequency corresponding to played notes, means including at least one additional bus-bar for gathering the first other pulse signals produced at said circuit junction point of all of said plurality of gating means of frequency corresponding to played notes, a second mixing amplifier having input and output terminals, and means for connecting said at least one additional bus-bar to the input terminal of said second mixing amplifier whereby to produce at its output terminal first other pulse signals of frequencies corresponding to played notes.

19. Apparatus according to claim 18, wherein each of said integrating circuit means comprises an operational amplifier having an inverting input terminal to which said first other pulse signals are applied, and an output terminal from which a feedback network including capacitive reactance is connected to said inverting input terminal.

20. Apparatus according to claim 19, wherein each of said first and second mixing amplifiers is an operational amplifier having an inverting input terminal providing a low impedance, a noninverting input terminal and an output terminal, wherein the output terminal of each of said integrator operational amplifiers is connected by a respective resistance network to the inverting input terminal of said first mixing amplifier, said resistive network having resistance values such that the sawtooth waveform signals produced at the output terminal of said first mixing amplifier are of substantially uniform amplitude throughout the frequency range of the musical instrument, and wherein said at least one additional bus-bar is capacitively coupled to the noninverting input terminal of said second mixing amplifier.

21. Apparatus according to claim 20, wherein said circuit junction point of each of said plurality of gating means is connected to said at least one additional bus-bar by a respective resistance network, said resistance network having resistance values such that the first other pulse signals produced at the output terminal of said second mixing amplifier are of substantially uniform amplitude throughout the frequency range of the musical instrument.

22. In an electronic musical instrument including sources of square wave signals having frequencies corresponding to the notes of a musical scale, a gating circuit for deriving from said square wave signals by operation of playing keys pulse signals of a wave shape differing from a square wave which contain both even and odd harmonics, said gating circuit comprising in combination:

electronic switch means connected to receive said square wave signal and operative to be closed and opened in response to the upper and lower levels, respectively, of said square wave signal, a source of direct current potential, a keyswitch and an RC time constant circuit, including a first resistor and a first capacitor, connected in series in that order beween said source of direct current potential and a circuit junction point, a second capacitor connected between said circuit junction point and a point of reference potential arranged to be charged at a predetermined rate from said source of direct current potential when said electronic switch means is open, and means including a diode connected between said circuit junction point and said electronic switch means arranged to discharge said second capacitor when said electronic switch means is closed, whereby to produce at a said circuit junction point a pulse signal differing from a sqare wave and containing both even and odd harmonics and of a frequency corresponding to the frequency of said square wave signal.

23. In a voicing system for an electronic musical instrument, the combination comprising:

a source of complex wave signal, a plurality of different filter networks each connected to receive and operative to modify the relative amplitudes of the various partial frequencies of said complex wave signal to produce a respective output signal representative of a distinctive organ voice, at least some of said filter networks, incidental to their filtering action, causing differing phase shifts of the fundamental and harmonic frequencies of the applied complex wave signal, a mixing amplifier having inverting and noninverting input terminals and an output terminal, means connected to the output terminal of said mixing amplifier for transducing signals produced thereat into sound, means for coupling the output signal from selected one or more of said filter networks to the noninverting input terminal of said mixing amplifier, and means for coupling the output signal from such other one or more of said filter networks to the inverting input terminal of said mixing amplifier as will maximize addition at the output terminals of said mixing amplifier of the stronger partials of the individual organ voice signals when two or more are sounded simultaneously.

* * * * *